US006279356B1

(12) United States Patent
Takahashi et al.

(10) Patent No.: US 6,279,356 B1
(45) Date of Patent: Aug. 28, 2001

(54) WARP-KNITTING FABRIC EXHIBITING INTERFERENCE COLOR TONE

(75) Inventors: Shigeru Takahashi; Fumio Hirota, both of Ibaraki (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 09/319,581

(22) PCT Filed: Oct. 6, 1998

(86) PCT No.: PCT/JP98/04519

§ 371 Date: Jun. 9, 1999

§ 102(e) Date: Jun. 9, 1999

(87) PCT Pub. No.: WO99/19550

PCT Pub. Date: Apr. 22, 1999

(30) Foreign Application Priority Data

Oct. 13, 1997 (JP) ..... 9-278565

(51) Int. Cl.[7] ..... D04B 21/06
(52) U.S. Cl. ..... 66/195
(58) Field of Search ..... 66/192, 195, 196, 66/190, 191, 193; 442/202, 312, 313, 314

(56) References Cited

U.S. PATENT DOCUMENTS

| | | | | |
|---|---|---|---|---|
| 3,834,193 | * | 9/1974 | Wilkens | 66/195 |
| 3,999,407 | * | 12/1976 | Odham | 66/193 |
| 5,711,169 | * | 1/1998 | Leeke et al. | 66/196 |

FOREIGN PATENT DOCUMENTS

| | | | |
|---|---|---|---|
| 55-180786 | 12/1980 | (JP) | D04B/1/12 |
| 61-640 | 1/1986 | (JP) | D03D/15/00 |
| 1-229851 | 9/1989 | (JP) | D04B/1/00 |
| 2-94283 | 7/1990 | (JP) | D04B/21/16 |
| 5-9859 | 1/1993 | (JP) | D05C/17/02 |
| 9-170139 | 6/1997 | (JP) | D03D/27/00 |

* cited by examiner

*Primary Examiner*—Danny Worrell
(74) *Attorney, Agent, or Firm*—Sughrue, Mion, Zinn, Macpeak & Seas, PLLC

(57) ABSTRACT

A warp-knitted fabric comprising a dark-colored base weave and an insertion weave of a lighter color than the base weave, wherein the base weave has formed therein mesh-like gaps with a maximum length of 0.5–15 mm which are present at 5–200 per square inch. The knitted fabric exhibits coloring effects such as enhanced luster and an iridescent effect, just as if interference colors were being expressed.

12 Claims, No Drawings

WARP-KNITTING FABRIC EXHIBITING INTERFERENCE COLOR TONE

TECHNICAL FIELD

The present invention relates to a warp-knitted fabric that exhibits an interference color tone with effects including improved luster and iridescence, and more specifically it relates to a warp-knitted fabric which appears to express interference colors and exhibit an effect of improved luster and iridescence by allowing the color-phase of a light-colored insertion weave to be visible to the viewer through mesh-like gaps formed in a deep-colored base weave.

BACKGROUND ART

Conventional fabrics are known which exhibit a fantastic, clear and bright color effect called "iridescence", and such fabrics are produced by the different methods described below ("New fiber discoveries —Revised 3rd edition", by Kazushi Yoshikawa, published Mar. 15, 1994 by Kamakura Shobo).

(1) The warp and weft separately dyed with single colors are plane woven or twill woven to produce a juxtaposed color mixture.

(2) A thin-film of a light reflecting layer and a transparent layer is formed on the fabric surface by sputtering.

(3) A textile is made from foil yarn prepared by combining a polarizing film with a molecular oriented anisotropic film.

However, method (1) above has a drawback in that it cannot be applied for knits whose warp and weft are not clearly distinguishable, and therefore products obtained thereby have limited uses. Methods (2) and (3) have disadvantages in that they require special apparatuses for production of fabrics and thus are very troublesome and costly, while they can only give fabrics with a hard hand.

DISCLOSURE OF THE INVENTION

It is an object of the present invention to solve the aforementioned problems of the prior art by providing a knitted fabric which exhibits color effects including improved luster and an iridescent effect, just as if interference colors were being expressed, by a simple method using a common knitting step.

As a result of diligent research aimed at achieving the object stated above, the present inventors have found that when the size of mesh-like gaps formed in a deep-colored base weave is specified and the color phase of a light-colored insertion weave is made visible to viewers through the mesh-like gaps, it appears as if interference colors are being expressed, and improved luster and an iridescent effect are thereby exhibited.

Thus, according to the present invention there is provided a warp-knitted fabric exhibiting an interference color tone, which is a warp-knitted fabric containing a dark-colored base weave and an insertion weave of a lighter color than the base weave, wherein the base weave has formed therein mesh-like gaps with a maximum length of 0.5–15 mm which are present at 5–200 per square inch.

BEST MODE FOR CARRYING OUT THE INVENTION

The warp-knitted fabric of the invention is a warp-knitted fabric containing a base weave in which mesh-like gaps are formed, and an insertion weave.

Here, the filaments composing the base weave may be either filaments or spun yarn of natural fibers, synthetic fibers such as polyester or nylon, or semi synthetic fibers such as rayon or acetate, having a total denier of 50–400 denier.

If the total denier of the filaments is less than 50 denier, the color phase of the insertion weave may be seen also from sections other than the mesh-like gaps described below, often reducing the color effect. On the other hand if the total denier of the filaments is greater than 400, the knitting may be rendered more difficult.

The filaments composing the insertion weave may be either filaments or spun yarn of natural fibers, synthetic fibers such as polyester or nylon, or semi synthetic fibers such as rayon or acetate, having a total denier of 50–400 denier.

If the total denier of the filaments is less than 50 denier, the pattern of the yarn may become non-uniform, and this may impair the surface of the knitted fabric. On the other hand if the total denier of the filaments is greater than 400 denier, the knitting may be rendered more difficult.

For a more pronounced color effect, the filaments composing the insertion weave are preferably filaments composed of fibers containing no more than 0.1 wt % of a delustering agent, known as bright filaments or superbright filaments, or modified cross-section fibers.

The filaments composing the insertion weave should maintain as flat a shape as possible in the knitted fabric from the standpoint of the color effect, and therefore the number of twists is preferably limited to no more than 80 T/M.

For a more uniform pattern of the filaments composing the insertion weave, it is preferred to also use pressing yarn with a total denier of 30–100 denier, and preferably 50–75 denier. The pressing yarn used may be any of the yarn types mentioned above, but it is preferably made of the same filaments as the filaments composing the base weave.

According to the invention, the base weave must be colored with a darker color than the insertion weave. The coloring method employed may be any desired method such as dip dyeing, textile printing or mass coloring, and examples thereof include a method wherein black mass-colored polyester filaments are used as the filaments composing the base weave and polyester filaments composing the insertion weave are dyed with a disperse dye, a method wherein cationic dye-dyeable polyester filaments are used as the filaments composing the base weave, and a basic dye and disperse dye are used together for separate dyeing of polyester filaments composing the insertion weave, and a method wherein the base weave is colored by mass coloring or dip dyeing, after which the insertion weave is textile printed.

When the insertion weave is textile printed, it is preferably printed from the opposite side from the base weave to avoid reducing the color effect.

It is preferred for the base weave to be colored black, or for the color phase of the base weave to be in a complementary relationship with the color phase of the insertion weave, for more notable expression of the color effect.

According to the invention, it is essential for the base weave to have gaps with a maximum length of 0.5–15 mm present at 5–200 per square inch.

Here, the maximum length of the gaps refers to the diameter of the gaps where they are circular, the length of the long side of the gaps where they are rectangular and the diameter of a circumscribed circle around the gaps where they are shapes other than circular or rectangular, and the value of the maximum length is preferably 1–7 mm when the gaps are circular and 3–15 mm when the gaps are rectangular.

If the value of the maximum length is less than 0.5 mm the resulting color effect will be reduced, and if the maximum length is greater than 15 mm the resulting color effect will not only be reduced but the zigzag spring of the yarn during knitting will be too large, making the knitting more difficult.

If the number of gaps is outside of the range specified above, the resulting color effect will be reduced. A preferred range for the number of gaps is 10–50 per square inch.

The multi-component warp-knitted fabric of the invention exhibits the following color effects due to its structure as described above.

(1) Since the color phase of the light-colored insertion weave can be seen through the openings interspersed in the dark-colored base weave, the luster of the insertion weave is even more pronounced.

(2) When the insertion weave is colored in multiple color phases by printing or the like, an iridescent effect is obtained just as if interference colors were being expressed.

(3) When the base weave is colored black, or the color phase of the base weave is in a complementary relationship with the color phase of the insertion weave, the color effect is more notable.

The present invention will now be explained, in more detail, by way of examples which, however, are in no way intended to restrict the invention.

Example 1

Using a 28-gauge warp knitting machine manufactured by Karl Mayer Co., 75 denier/36 filament polyester black mass-colored filament yarn was supplied to reeds L1 and L2 for knitting of a base weave of a chequered pattern with an 18 course repeat of a 7-in, 1-out yarn pattern, while 75 denier/36 filament super-bright polyester filament yarn was supplied as insertion yarn to reed L3 and 75 denier/36 filament polyester black mass-colored filament yarn to reed L4 as pressing yarn for the insertion yarn, for knitting at an 86 course/inch knit density to obtain a warp-knitted fabric comprising a base weave with mesh-like gaps formed therein and an insertion weave.

The knitted fabric was scoured at 8° C. for 10 minutes in a 1 g/l aqueous solution of Scour Roll 700 (surfactant, product of Kao, KK.) at a bath ratio of 1:30, after which it was dried at 130° C. for 2 minutes and then heat treated at 180° C. for 1 minute.

The warp-knitted fabric was then dyed at 130° C. for 30 minutes using a jet dyeing machine (Circular Model NX, product of Hisaka Seisakusho, KK.) with 1.0% o.w.f. of Teratop Red NFR (disperse dye, product of Ciba Special Chemicals, KK.), after which it was dried at 120° C. for 2 minutes and then subjected to heat treatment at 160° C. for 45 seconds.

The resulting warp-knitted fabric had gaps with a long side of 3 mm and a short side of 2 mm present at 36 per square inch in the black base weave, and the red color of the highly glossy insertion weave could be seen through the gaps, exhibiting an iridescent effect just as if interference colors were being expressed.

Example 2

Using a 28-gauge warp knitting machine manufactured by Karl Mayer Co., 75 denier/24 filament cationic tingible polyester filament yarn was supplied to reeds L1 and L2 for knitting of a base weave of a chequered pattern with an 18 course repeat of a 7-in, 1-out yarn pattern, while 75 denier/36 filament super-bright polyester filament yarn was supplied as insertion yarn to reed L3 and 75 denier/24 filament cationic dye-tingible polyester filament yarn to reed L4 as pressing yarn for the insertion yarn, for knitting at an 86 course/inch knit density to obtain a warp-knitted fabric comprising a base weave with mesh-like gaps formed therein and an insertion weave.

The knitted fabric was scoured at 80° C. for 10 minutes in a 1 g/l aqueous solution of Scour Roll 700 (surfactant, product of Kao, KK.) at a bath ratio of 1:30, after which it was dried at 130° C. for 2 minutes and then heat treated at 180° C. for 1 minute.

The warp-knitted fabric was then dyed at 130° C. for 30 minutes using a jet dyeing machine (Circular Model NX, product of Hisaka Seisakusho, KK.) with 2.0% o.w.f. of Kayacryl Yellow 3 GS-ED (basic dye, product of Nihon Kayaku, KK.) and 4.0% o.w.f. of Kayacryl Blue GSL-ED (basic dye, product of Nihon Kayaku, KK.), coloring the base weave dark green and the insertion weave yellow, after which it was dried at 120° C. for 2 minutes and then subjected to heat treatment at 160° C. for 45 seconds.

Next, a rotary screen textile printer was used for print working of the four colors yellow, red, blue and violet on the side of the insertion weave of the warp knitted fabric opposite the side of the base weave, and after drying at 120° C. for 5 minutes, vapor at a vapor pressure of 3 kg/cm$^2$ was supplied at a rate of 250 l/min for coloring treatment at 165° C. for 10 minutes, and the unattached dye and sizing agent were washed off by cold water washing, hot water washing, reduction washing and hot water washing in that order, followed by drying and heat treatment.

The resulting warp-knitted fabric had gaps with a long side of 3 mm and a short side of 2 mm present at 36 per square inch in the dark green base weave, and the print pattern of the highly glossy insertion weave could be seen through the gaps, exhibiting an iridescent effect just as if interference colors were being expressed.

Comparative Example 1

Treatment was carried out in the same manner as Example 1, except that the denier of the polyester black mass-colored filament yarn was 225 denier/108 filaments, the number of twists was 80 T/M, and a base weave of a chequered pattern with a 100 course repeat of a 7-in, 1-out yarn pattern was knitted.

The resulting warp-knitted fabric had gaps with a long side of 20 mm and a short side of 4 mm formed at only 4 per square inch in the black base weave, and the maximum length of the gaps was too large, so that a satisfactory iridescent effect was not expressed.

Comparative Example 2

Treatment was carried out in the same manner as Example 1, except that 75 denier/36 filament super-bright polyester filament yarn was supplied to reeds L1 and L2 while 75 denier/36 filament polyester black mass-colored filament yarn was supplied to reed L3 as insertion yarn.

The resulting multi-component warp-knitted fabric had gaps with a long side of 3 mm and a short side of 2 mm formed at 36 per square inch in the red base weave, and while the black color of the insertion weave could be seen through the gaps, the base weave was lighter than the insertion weave, and therefore a satisfactory iridescent effect was not expressed.

INDUSTRIAL APPLICABILITY

According to the present invention there may be provided knitted fabrics that exhibit coloring effects such as enhanced luster and an iridescent effect.

What is claimed is:

1. A warp-knitted fabric, exhibiting an interference color tone, which comprises a dark-colored base weave and an insertion weave of a lighter color than said base weave, wherein said base weave has formed therein mesh-like gaps with a maximum length of 0.5–15 mm which are present at 5–200 per square inch;

wherein the warp-knitted fabric is a two layered knitted fabric having the base and insertion weaves.

2. A warp-knitted fabric according to claim 1, wherein the color phase of the base weave and the color phase of the insertion weave are in a complementary relationship.

3. A warp-knitted fabric according to claim 1 or 2, wherein the insertion weave is colored by textile printing.

4. A warp-knitted fabric according to claim 1, wherein the insertion weave comprises filaments which contain no more than 0.1 wt % of a delustering agent.

5. A warp-knitted fabric according to claim 1, wherein the insertion weave comprises filaments which are modified cross-section fibers.

6. A warp-knitted fabric according to claim 2, wherein the insertion weave comprises filaments which contain no more than 0.1 wt % of a delustering agent.

7. A warp-knitted fabric according to claim 3, wherein the insertion weave comprises filaments which contain no more than 0.1 wt % of a delustering agent.

8. A warp-knitted fabric according to claim 2, wherein the insertion weave comprises filaments which are modified cross-section fibers.

9. A warp-knitted fabric according to claim 3, wherein the insertion weave comprises filaments which are modified cross-section fibers.

10. A warp-knitted fabric according to claim 4, wherein the insertion weave comprises filaments which are modified cross-section fibers.

11. A warp-knitted fabric according to claim 6, wherein the insertion weave comprises filaments which are modified cross-section fibers.

12. A warp-knitted fabric according to claim 7, wherein the insertion weave comprises filaments which are modified cross-section fibers.

* * * * *